United States Patent [19]

Kleeger

[11] 4,456,256

[45] Jun. 26, 1984

[54] CHUKA STICK SYSTEMS

[76] Inventor: Douglas Kleeger, 404 Jefferson St., Massapequa, N.Y. 11758

[21] Appl. No.: 475,473

[22] Filed: Mar. 15, 1983

[51] Int. Cl.[3] ..... F41B 15/02

[52] U.S. Cl. ..... 273/84 R; 273/58 C

[58] Field of Search ..... 273/84 R, 84 ES, 191 B, 273/1 R, 58 C; 272/93, 124

[56] References Cited

U.S. PATENT DOCUMENTS 3,454,274 7/1969 Kaneshiro ..... 273/84 R X 3,937,468 2/1976 Conde ..... 273/84 R

*Primary Examiner*—George J. Marlo

*Attorney, Agent, or Firm*—Collard, Roe & Galgano

[57] ABSTRACT

In a chuka stick system including a longitudinal rod, and a loop connected to one or both ends of the rod, the improvement consisting of first, second and third bores formed in at least one end of the rod. The first and second bores have an axis substantially perpendicular with the longitudinal direction of the rod, while the third bore is a blind bore open at one end of the rod, and communicates with the first bore. The first bore is spaced at a predetermined distance from the open end, and the second bore is spaced from the open end by a prearranged distance which exceeds the predetermined distance. The loop includes a rope which has an outside portion, inclusive of first and second longitudinal rope portions, and a central portion which connects the first and second portions. First and second rope end portions are partly disposed in the first and second bores, tied together at their extremities, and crossed-over with respect to the first and second longitudinal rope portions, respectively. It is possible to have any number of chuka sticks joined together at their ends in the present invention.

8 Claims, 10 Drawing Figures

FIG. 1
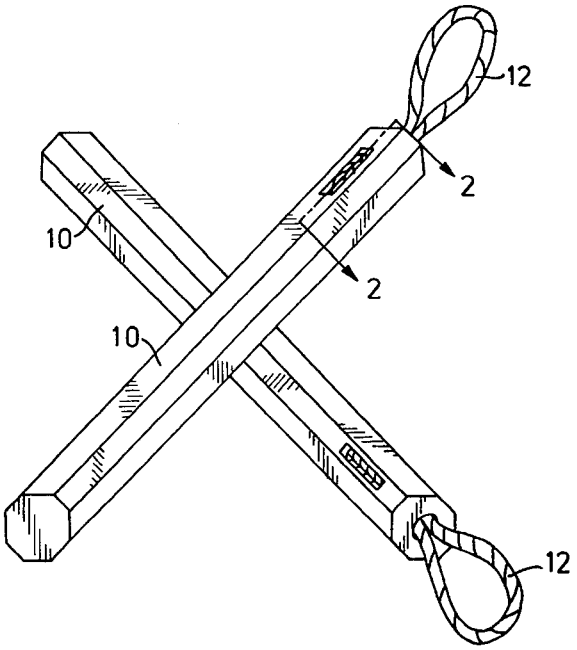
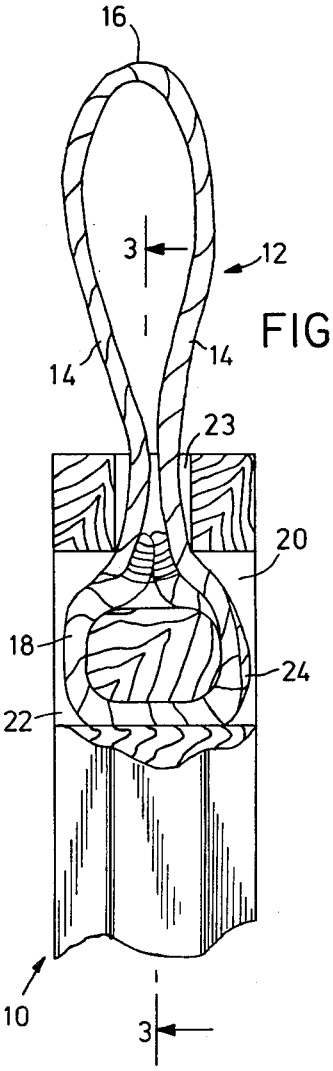
FIG. 2
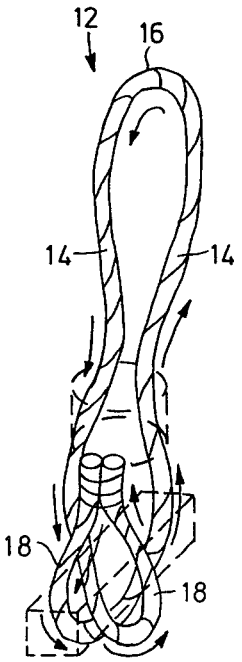
FIG. 4
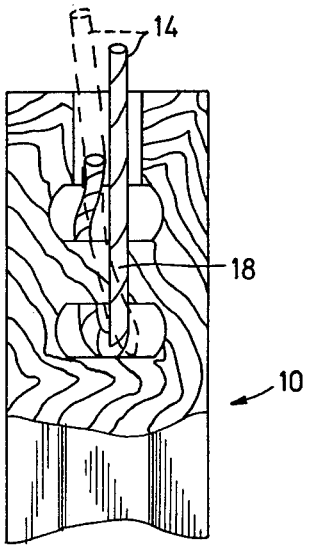
FIG. 3

FIG. 5
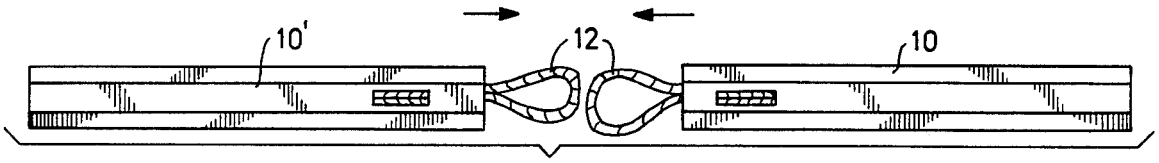
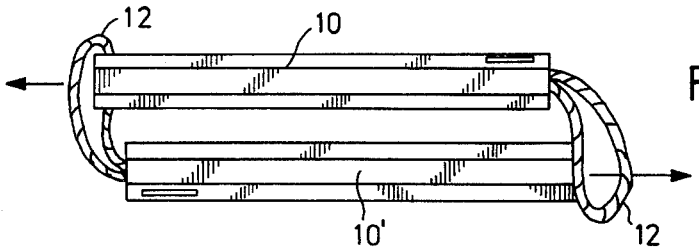
FIG. 6
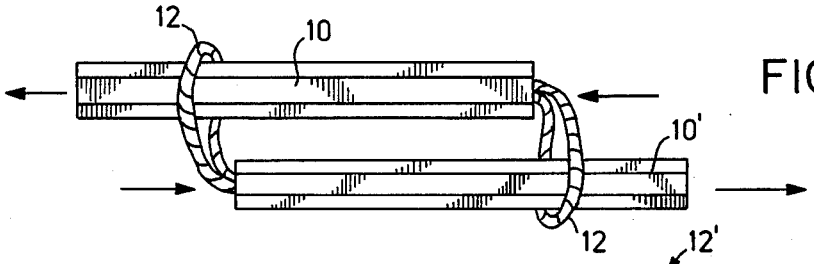
FIG. 7
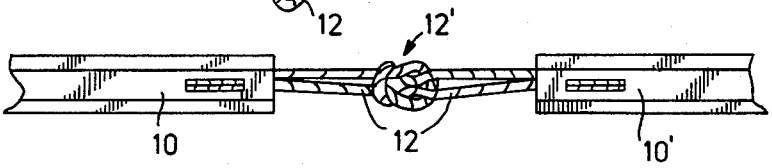
FIG. 8
FIG. 9
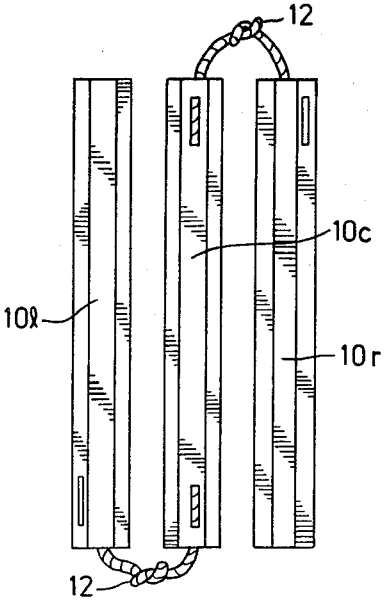
FIG. 10
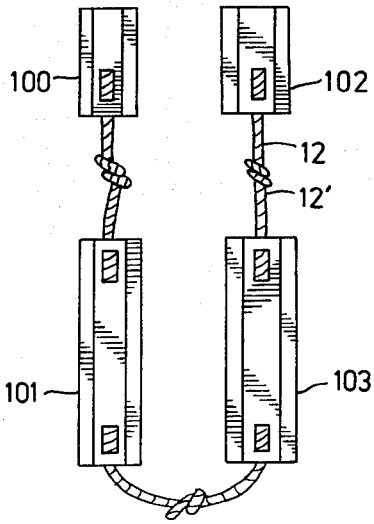

CHUKA STICK SYSTEMS

BACKGROUND OF THE INVENTION

1. Field of the Invention

The field of the present invention relates to the chuka stick system.

2. Description of the Prior Art

Chuka sticks, also called nunchukas and centrifugal force sticks are usually constructed as a pair of longitudinal rods of polygonal cross-section, preferably an octagonal cross-section. The chuka sticks are joined together at their ends by a length of cord or chain so that when one of the sticks is held in the hand, the other stick can be swung at great velocity in different directions. The chuka sticks are used in martial arts training such as in karate.

Conventional chuka sticks are sold in pairs and are tied together at their ends by a conventional cord or string. In some states, chuka sticks are considered illegal weapons and one caught in possession of a pair of chuka sticks connected together, can be subject to conviction of a felony. It is therefore difficult for those who teach martial arts or perform in exhibitions to transport their chuka sticks through these states on their way to various martial arts events, since they cannot be quickly disassembled.

In the present invention, chuka sticks are provided singly, each having their own loop or loops so that they can be legally transported and later assembled at martial arts events into a pair of chuka sticks.

SUMMARY OF THE INVENTION

It is another object of the present invention to provide individual chuka sticks, each with a loop or loops in such a fashion so that two or more chuka sticks, can be assembled, and easily connected to one another, with the aid of the existing loops without the neccessity of tying any knots into the loops, or using any external rope to tie the loops to one another.

This object is achieved in a chuka stick system, including a longitudinal rod of any length, and where the rod cross-section could be round, flat or polygonal, and include a loop connected to one or both ends of the rod by providing first, second and third bores formed in the rod. The first and second bores have an axis substantially perpendicular with the longitudinal direction of the rod, while the third bore is a blind bore, open at one end of the rod, and communicates with the first bore. The first bore is spaced at a predetermined distance from the open end, and the second bore is spaced from the open end by a prearranged distance which exceeds the predetermined distance. The loop includes a rope which has an outside portion, inclusive of first and second longitudinal rope portions, and a third portion which connects the first and second portions. First and second end portions of the rope are disposed in the first and second bores, tied together at their extremities, and crossed over with respect to the first and second longitudinal rope portions.

BRIEF DESCRIPTION OF THE DRAWINGS

Other objects and features of the present invention will become apparent from the following detailed description considered in connection with the accompanying drawings, which disclose several embodiments of the invention. It is to be understood that the drawings are to be used for the purposes of illustration only, and not as a definition of the limits of the invention.

In the drawings, wherein similar reference characters denote similar elements throughout the several views:

FIG. 1 is a perspective view of two chuka sticks, according to the present invention, suitable for being connected to one another without any additional rope or knots being formed;

FIG. 2 is an elevational cross-section of a chuka stick, according to the present invention, along lines 2—2 in FIG. 1;

FIG. 3 is a cross-section along lines 3—3 of FIG. 2;

FIG. 4 is a perspective view showing the formation of a loop for a chuka stick, according to the present invention, with the ends of the rope pieces forming a loop being tied to one another and hidden internally within the chuka stick, as shown in FIG. 2;

FIG. 5 is a side view of two chuka sticks juxtaposed with the loop portions facing one another;

FIG. 6 is a side view of the chuka sticks shown in FIG. 5, showing a first stage in the process of connecting chuka sticks to one another without using any additional means;

FIG. 7 is a second stage of the process illustrated in FIG. 6, with the chuka sticks approaching one another;

FIG. 8 is the end stage of the process, illustrated in FIGS. 6 and 7, of connecting two chuka sticks to one another, there being visible the knot formation as a result of the two loops being tied to one another without the aid of any external device;

FIG. 9 is an elevational view of an alternate system of chuka sticks, showing a central chuka stick and two outside Chuka sticks, the central chuka stick being provided with a loop on each end thereof; and FIG. 10 is an elevational view of another alternate system of chuka sticks showing four sticks connected at their adjacent ends, of different length.

DESCRIPTION OF THE PREFERRED EMBODIMENT

Referring now to the drawings, and in particular to FIGS. 1-3, there will be seen two chuka sticks 10, each being formed with a loop 12. It will be seen that the loop 12 consists of an outside portion having first and second longitudinal rope portions 14, which are joined by a central portion 16, and first and second end portions 18 partly disposed in a first bore 20, and in a second bore 22 of the chuka stick or rod 10; both the bore 20 and the bore 22 have axes substantially perpendicular to the longitudinal direction of the chuka stick 10. The end portions 18 are tied together at two ends of the rope in such a way that they are crossed over with respect to the longitudinal rope portions 14, as can be seen most clearly from FIG. 4. Longitudal grooves 24 communicate with the bores 20 and 22, and the bores 20 and 22 communicate with a blind bore 23 perpendicular to the bores 20 and 22. The bores 20 and 22 are provided for holding parts of the first and second end portions 18, so that these end portions 18 do not protrude beyond the periphery of the stick or rod 10. A chuka stick is typically made by first drilling out the bores 20, 22, and 23, and then carving or reaming out the connecting grooves 25. FIG. 3 shows more clearly how the rope end portions 18 pass from one side of the rod 10 to another side thereof.

In FIG. 5, there are shown two chuka sticks 10 and 10' juxtaposed with one another in a starting position in such a way that the loops 12 face one another. The chuka sticks 10 and 10' are then moved towards one another until they reach the position shown in FIG. 6.

In FIGS. 6 through 8 there is then illustrated a process how the two chuka sticks 10 and 10', each being formed with a loop 12, are connected to one another without using any external device.

In FIG. 6, two chuka sticks 10 and 10' are facing each other side-by-side, with the loop 12 of the lowermost chuka stick 10' being ready to slide over the topmost chuka stick 10, while the loop 12 of the topmost chuka stick 10 is ready to be slid over the lowermost chuka stick 10'.

FIG. 7 shows how the loop 12 of the lowermost chuka stick 10' slides over the topmost chuka stick 10, when the topmost chuka stick 10 is moved away relative to the lower chuka stick 10', and the loop 12 of the topmost chuka stick 10 will be seen to be slid over the lowermost chuka stick 10'. In FIG. 8 this process is shown completed, and the formation of a knot 12' made of the two loops 12 will be evident.

In FIG. 9 there will be seen a central chuka stick $\mathbf{10}_c$ which is formed with a loop 12 at each end thereof. The rightmost chuka stick $\mathbf{10}_r$ can be connected to the center chuka stick $\mathbf{10}_c$ in the manner illustrated in FIGS. 6 through 8, and likewise the leftmost chuka stick $\mathbf{10}_l$ can be connected to the central chuka stick $\mathbf{10}_c$ in a similar manner.

In FIG. 10, there is shown four chuka sticks 100, 101, 102 and 103 of different lengths joined by loops 12 to form knots 12' between adjacent ends of the rods. There can be any combination of sticks both in number and length, according to the invention.

While only several embodiments of the present invention have been shown and described, it is obvious that many changes and modifications may be made thereunto, without departing from the spirit and scope of the invention.

What is claimed is:

1. In a chuka stick system including a longitudinal rod and a loop connected to one or both ends of the rod, the improvement comprising:

first, second and third bores formed in the rod, said first and second bores having an axis substantially perpendicular with the longitudinal direction of the rod, the third bore being a blind bore open at one end of the rod and communicating with said first bore, said first bore being spaced at a predetermined distance from said open end, said second bore being spaced from said open end by a prearranged distance exceeding said predetermined distance;

said loop including a rope having an outside portion, including first and second longitudinal rope portions, and a central portion connecting said first and second portions, and first and second end portions partly disposed in said first and second bores, tied together at their extremities and crossed-over with respect to said first and second longitudinal rope portions, respectively, thereby defining a chuka stick with a loop at one end.

2. The chuka stick system as claimed in claim 1, wherein the rod is further formed with oppositely disposed longitudinal grooves, each communicating with said first and second bores.

3. The chuka stick system as claimed in claim 1, further comprising another rod, and wherein the loop of each one of the rods is slidable over a loop-free end of the other of the rods in respective opposite directions, until said loops form a knot.

4. The chuka stick system as claimed in claim 1, further comprising another loop connected to the other end of the rod, and fourth, fifth and sixth bores formed in the rod, said fourth and fifth bores having an axis substantially perpendicular with the longitudinal direction of the rod, the sixth bore being a blind bore open at said other end of the rod and communicating with said fourth bore, said fourth bore being spaced at a predetermined distance from said other open end, said fifth bore being spaced from said other open end by a prearranged distance exceeding said predetermined distance;

said other loop including another rope having an outside portion, including first and second longitudinal rope portions, and a central portion connecting said first and second portions, and first and second end portions partly disposed in said fourth and fifth bores, tied together at their extremities and crossed-over with respect to said first and second longitudinal portions, thereby constituting a chuka stick with a loop at each end.

5. The chuka stick system as claimed in claim 4 further comprising another rod, and wherein a loop of each one of the rods is slidable over a looped or loop-free end of the other of the rods in respective opposite directions until the loops form a knot.

6. The chuka stick system as claimed in claim 4, further comprising two other rods, each being similar to the rod as claimed in claim 1, and wherein each loop of the rod as claimed in claim 4 is slidable over a looped or loop-free end of a respective of the other rods in respective opposite directions until corresponding of said loops form two respective knots.

7. The chuka stick system as claimed in claim 4, wherein said rod is further formed with oppositely disposed longitudinal grooves, each communicating with said first, second, fourth and fifth bores.

8. In a chuka stick system including at least two longitudinal rods wherein at least one rod has at least one loop, and wherein at least one other rod in the combination has two loops, one loop being at each end of the other rod, the improvement comprising:

first, second and third bores formed in at least one end of the rods for each loop on the rods, said first and second bores having an axis substantially perpendicular with the longitudinal direction of the rods, the third bore being a blind bore open at one end of the rods and communicating with said first bore, said first bore being spaced at a predetermined distance from said open end, said second bore being spaced from said open end by a prearranged distance exceeding said predetermined distance, said at least one loop including a rope having an outside portion, including first and second longitudinal rope portions, and a central portion connecting said first and second portions, and first and second end portions partly disposed in said first and second bores, tied together at their extremities and crossed-over with respect to said first and second longitudinal rope portions, respectively, so that various combinations of single loop rods and double looped rods can be slid over each other in opposite directions to form knots between the adjacent ends of the rods.

* * * * *